US007629932B2

(12) United States Patent
Wang et al.

(10) Patent No.: US 7,629,932 B2
(45) Date of Patent: Dec. 8, 2009

(54) ANTENNA APPARATUS, AND ASSOCIATED METHODOLOGY, FOR A MULTI-BAND RADIO DEVICE

(75) Inventors: Dong Wang, Waterloo (CA); Geyi Wen, Waterloo (CA); Qinjiang Rao, Waterloo (CA); Mark Pecen, Waterloo (CA)

(73) Assignee: Research In Motion Limited, Waterloo (CA)

( * ) Notice: Subject to any disclaimer, the term of this patent is extended or adjusted under 35 U.S.C. 154(b) by 25 days.

(21) Appl. No.: 11/690,427

(22) Filed: Mar. 23, 2007

(65) Prior Publication Data

US 2008/0231531 A1 Sep. 25, 2008

(51) Int. Cl.
*H01Q 1/24* (2006.01)

(52) U.S. Cl. ..... 343/702; 343/700 MS; 343/866

(58) Field of Classification Search ..... 343/702, 343/700 MS, 866
See application file for complete search history.

(56) References Cited

U.S. PATENT DOCUMENTS 6,404,391 B1 6/2002 Apostolos
6,630,909 B2 10/2003 Nepveu
6,995,717 B2 * 2/2006 Ryu ..... 343/702
2004/0252061 A1 * 12/2004 Vance ..... 343/702
2004/0263396 A1 * 12/2004 Sung ..... 343/702
2005/0270243 A1 12/2005 Caimi et al.

FOREIGN PATENT DOCUMENTS

EP 1542313 A1 6/2005
EP 1555715 A1 7/2005
EP 1555717 A1 7/2005
EP 1739788 A1 3/2007
WO 0126182 A1 4/2001

* cited by examiner

*Primary Examiner*—Trinh V Dinh
*Assistant Examiner*—Dieu Hien T Duong

(57) ABSTRACT

Antenna apparatus, and an associated methodology, for a multi-frequency-band-capable radio device, such as a quad-band mobile station. The antenna apparatus forms a hybrid strip antenna having a pair of resonant elements. A first resonant element forms a peripheral loop extending about the periphery of a substrate. A meander line extends along a portion of the peripheral loop. And, second resonant element is formed of an L-shaped strip. The peripheral loop is resonant at a set of frequencies, and the L-shaped strip is resonant at a single frequency. Through appropriate selection of the lengths of the resonant elements, the frequencies at which the elements are resonant are controlled.

17 Claims, 4 Drawing Sheets

ANTENNA APPARATUS, AND ASSOCIATED METHODOLOGY, FOR A MULTI-BAND RADIO DEVICE

The present invention relates generally to an antenna construction for a mobile station, or other radio device, operable over multiple frequency bands. More particularly, the present invention relates to antenna apparatus, and an associated methodology, forming a hybrid strip antenna of a multi-mode mobile station, or other radio device, operable, e.g., at the 800/900/1800/1900 MHz frequency bands.

The antenna includes radiation elements comprising a loop strip including a meander line as a portion and an L-shaped strip, both disposed upon a substrate and configured to resonate at frequencies corresponding to the frequency bands at which the radio device is operable. The antenna is of compact dimensions and exhibits stable frequency band characteristics and radiation patterns.

BACKGROUND OF THE INVENTION

For many, availability and use of mobile radio communication systems through which to communicate are necessary aspects of daily life. Cellular, and cellular-like, communication systems are exemplary radio communication systems whose infrastructures have been widely deployed and regularly utilized. Successive generations of cellular communication systems have been developed, the operating parameters and protocols of which are set forth in standards promulgated by standard-setting bodies. And, successive generations of network apparatus have been deployed, each operable in conformity with an associated operating standard.

While early-generation cellular communication systems provided voice communication services and limited data communication services, successor-generation, cellular communication systems provide increasingly data-intensive data communication services. Differing operating standards not only provide different communication capabilities, but utilize different communication technologies and differing frequencies of operation. The installation of different types of cellular communication systems is sometimes jurisdictionally dependent. That is to say, in different areas, network infrastructures, operable pursuant to different types of operating standards, are deployed. The network infrastructures deployed in the different areas are not necessarily compatible. A mobile station operable to communicate by way of network infrastructure constructed in conformity with one operating specification is not necessarily operable to communicate by way of network infrastructure operable pursuant to another operating standard.

So-called, multi-mode mobile stations have been developed that provide the mobile station with communication capability in more than one, i.e., multiple, communication systems. Generally, such multi-mode mobile stations automatically select the manner by which the mobile station is to be operable, responsive to the detected network infrastructure in whose coverage area that the mobile station is positioned. If positioned in the coverage area of the network infrastructures of more than one type of communication system with which the mobile station is capable of communicating, selection is made pursuant to a preference scheme, or manually. When provided with multi-mode capability, the mobile station contains circuitry and circuit elements permitting its operation to communicate pursuant to each of the communication systems. Most simply, a multi-mode mobile station is formed of separate circuitry, separately operable to communicate pursuant to the different operating standards. Sometimes, to the extent that circuit elements of the different circuit paths can be shared, parts of the separate circuit paths are constructed to be intertwined, or otherwise shared. By sharing circuit elements, the circuitry size and part count is reduced, resulting in cost and size savings.

Sharing of antenna transducer elements between the different circuit paths, however, presents unique challenges. The required size of an antenna transducer element is, in part, dependent upon the frequencies of the signal energy that is to be transduced by the transducer element. And, as mobile station constructions become increasingly miniaturized, housed in housings of increasingly small package sizes, antenna transducer design becomes increasingly difficult, particularly in multi-mode mobile stations when the different modes operate at different frequencies. Significant effort has been exerted to construct an antenna transducer, operable over multiple frequency bands, and also of small dimension to permit its positioning within the housing of a mobile station of compact size.

A PIFA (Planner Inverted-F Antenna) is sometimes utilized. A PIFA is generally of compact size, of low profile, and permitting of radiation in dual bands. Such antenna structures, however, generally exhibit narrow bandwidths. To enhance the bandwidth of a PIFA, the structure of the PIFA is sometimes combined together with a parasitic element, or a multi-layered, three-dimensional structure. Such additions, however, increase the volumetric dimensions of the antenna. Additionally, tuning of the antenna becomes difficult due to the additional resonant branches. And, the branches sometimes introduce EMC and EMI that interferes with transducing of signal energy.

A need, therefore, continues for an improved antenna structure, of small dimensions, and permitting of use over multiple frequency bands.

It is in light of this background information related to antenna transducers for radio devices that the significant improvements of the present invention have evolved.

DETAILED DESCRIPTION

Figure 1:
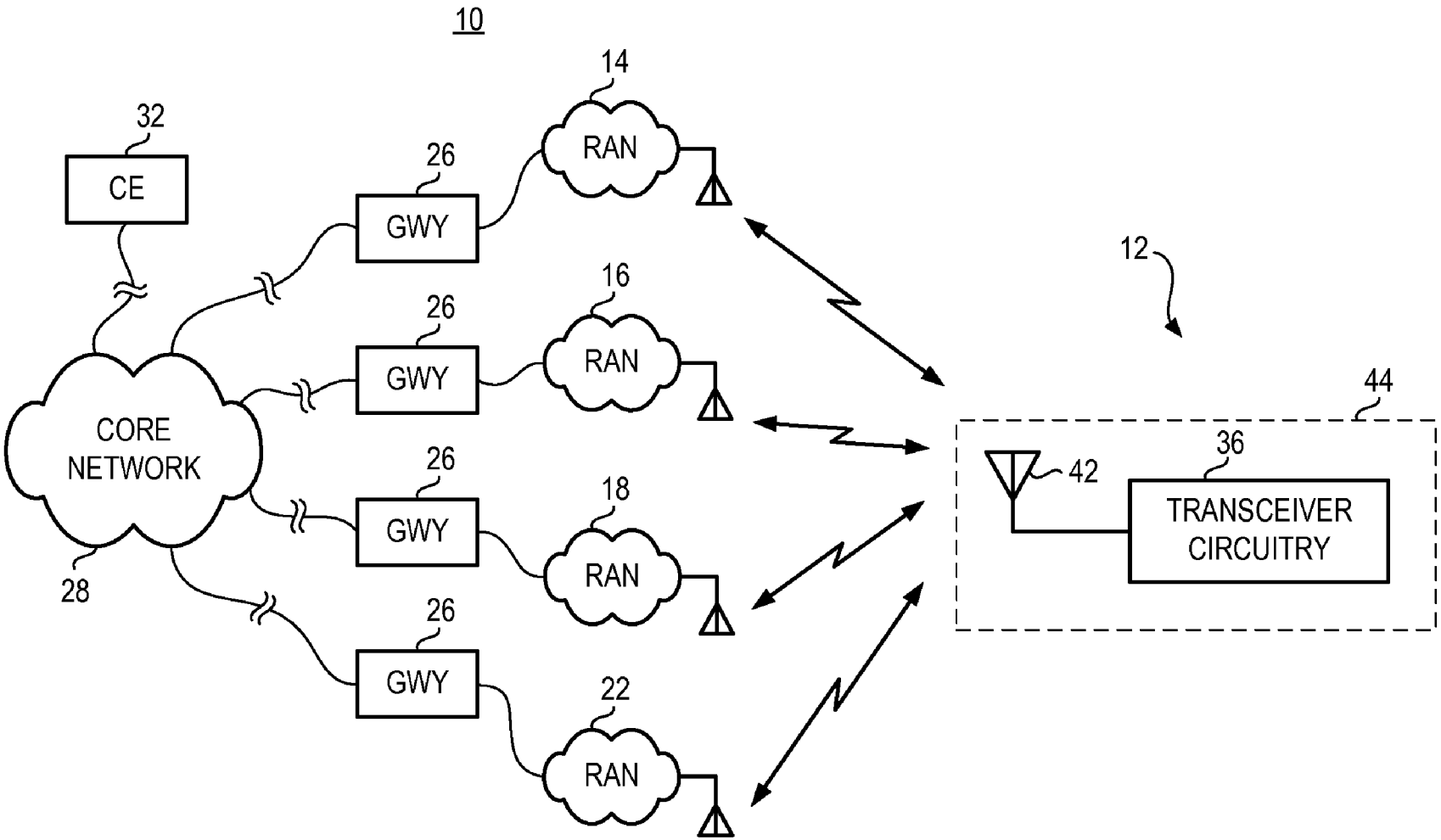
FIG. 1 illustrates a functional block diagram of a radio communication system in which an embodiment of the present invention is operable.

The present invention, accordingly, advantageously provides antenna apparatus, and an associated method, for a mobile station, or other radio device, operable over multiple frequency bands.

Through operation of an embodiment of the present invention, a manner is provided by which to form a hybrid strip antenna of a multi-mode mobile station, or other radio device, operable, e.g., at the 800/900/1800/1900 MHz frequency bands.

In one aspect of the present invention, an antenna is formed of first and second radiation elements including a loop strip and an L-shaped strip. Radiation elements are configured to resonate at frequencies that correspond to frequency bands at which the radio device is operable.

In one aspect of the present invention, a substrate is provided that is of dimensions permitting its seating within the housing of a mobile station, or other radio device of compact dimensions. The substrate is of rectangular, or other geometric, configuration and is permitting of painting, or other application, of a conductive material thereon. The dimensions of the substrate are great enough to permit formation of a conductive loop thereon. The loop strip is of a length that resonates at a frequency band at which the mobile station is formed on the substrate. The loop is formed about a periphery, such as extending to peripheral edges, of the substrate. A feed connection and a ground connection are further provided at the loop formed about the periphery of the substrate. The length of the loop strip is determinative of a first resonant frequency band. That is to say, the length of the loop resonates within a first frequency band. Through proper selection of the length of the loop, the loop is resonant at a frequency band corresponding to a frequency band of operation of at least one of the modes of operation of the mobile station.

In another aspect of the present invention, a portion of the loop that extends about the periphery of the substrate includes a meander line. The meander line is formed, for instance, along one of the peripheries of the substrate at which the loop is formed. The meander line is of a length that is resonant at a second frequency band. The second frequency band at which the meander line is resonant is determined by its length. And, through appropriate selection of the length of the meander line, the meander line portion of the loop is caused to resonate at a frequency band corresponding to a frequency band of operation of the multi-mode mobile station. The meander line is formed, e.g., by interdigitation of nonconductive segments, i.e., digits, into a rectangular swath of conductive material forming a portion of the loop formed about the periphery of the substrate. The length of the meander line is increased by increasing the interdigitation of the nonconductive segments or digits. An appropriate resonant frequency is made by use of a correspondingly appropriate amount of interdigitation.

The loop, formed about the periphery of the substrate, and including a meander line as a portion thereof, thereby defines a set of resonant frequency bands, the first of which is defined by the entire length of the loop including the length of the meander line, and a second of which is defined by the length of the meander line.

In another aspect of the present invention, an L-shaped strip is also formed on the substrate. The L-shaped strip is formed at an interior area defined by the loop that extends about the periphery of the substrate. An end portion of the L-shaped strip is electrically coupled to the peripheral loop. The L-shaped strip is coupled to the peripheral loop, for instance, by way of an end side of the shorter side of the L-shaped strip. The L-shaped strip resonates at a resonant frequency band. The resonant frequency band at which the L-shaped strip is resonant is dependent upon the length of the strip. Through appropriate selection of the length of the strip, the resonant frequency band at which the strip resonates corresponds to a frequency band of operation of the mobile station to which the antenna is coupled.

In one implementation, the antenna is used in a multi-band, cellular mobile station operable in the 800/900/1800/1900 MHz frequency bands. The configuration of the peripheral loop and the L-shaped strip is selected to cause resonance at the frequencies encompassing the bands at which the mobile station is operable. The length of the peripheral loop defines a lower-frequency band and the lengths of the meander line and the L-shaped strip are resonant at a higher frequency band. The higher frequency bands at which the meander line and at which the L-shaped strip are resonant at a higher frequency band. The higher frequency bands at which the meander line and at which the L-shaped strip overlap one another or are cumulative to correspond to the higher frequencies of operation of the mobile station.

Due to the compact size, stability of operation, and stable radiation pattern provided by the antenna, the antenna is advantageously utilized in a mobile station, or other radio device, of small volumetric dimensions.

In these and other aspects, therefore, a hybrid strip antenna, and an associated methodology is provided for a communication device. The hybrid strip antenna is embodied upon a substrate. A first radiation element is formed of a loop. The loop is configured to cause the first radiation element to be resonant within a first set of frequency bands. A second radiation element is formed of an L-shaped strip that is coupled to, and extends beyond the loop forming the first radiation element. The L-shaped strip is configured to cause the second radiation element to be resonant within a second set of frequency bands.

Turning, therefore, first to FIG. 1, a radio communication system, shown generally at 10, provides for radio communications with mobile stations, of which the mobile station 12 is representative. The mobile station 12 is here representative of a quad-mode mobile station, capable of communicating at the 800/900/1800/1900 MHz frequency bands. Such a mobile station is sometimes referred to as a world-band mobile station as the mobile station is operable in conformity with the operating specifications and protocols of the cellular communication systems that presently are predominant. More generally, the mobile station is representative of various radio devices that are operable over multiple bands or large bandwidths at relatively high frequencies.

Radio access networks 14, 16, 18, and 22 are representative of four radio networks operable respectively at the 800, 900, 1800, and 1900 MHz frequency bands, respectively. When the mobile station 12 is positioned within the coverage area of any of the radio access networks 14-22, the mobile station is capable of communicating therewith. If the separate networks have overlapping coverage areas, then the selection is made as to which of the networks through which to communicate. The radio access networks 14-22 are coupled, here by way of gateways (GWYs) 26 to a core network 28. A communication endpoint (CE) 32 that is representative of a communication device that communicates with the mobile station.

The mobile station includes a radio transceiver having transceiver circuitry 36 capable of transceiving communication signals with any of the networks 14-22. The transceiver circuitry includes separate or shared transceiver paths constructed to be operable with the operating standards and protocols of the respective networks. The radio station further includes an antenna 42 of an embodiment of the present invention. The antenna is of characteristics to be operable at the different frequency bands at which the transceiver circuitry and the radio access networks are operable. Here, the antenna is operable at the 800, 900, 1800, and 1900 MHz frequency bands. In the exemplary implementation, the antenna 42 is housed together with the transceiver circuitry, in a housing 44 of the mobile station. As the space within the housing that is available to house the antenna is limited, the dimensions of the antenna 42 are correspondingly small while providing for the transducing of signal energy by the antenna over broad frequencies at which the mobile station is operable.

Figure 2:
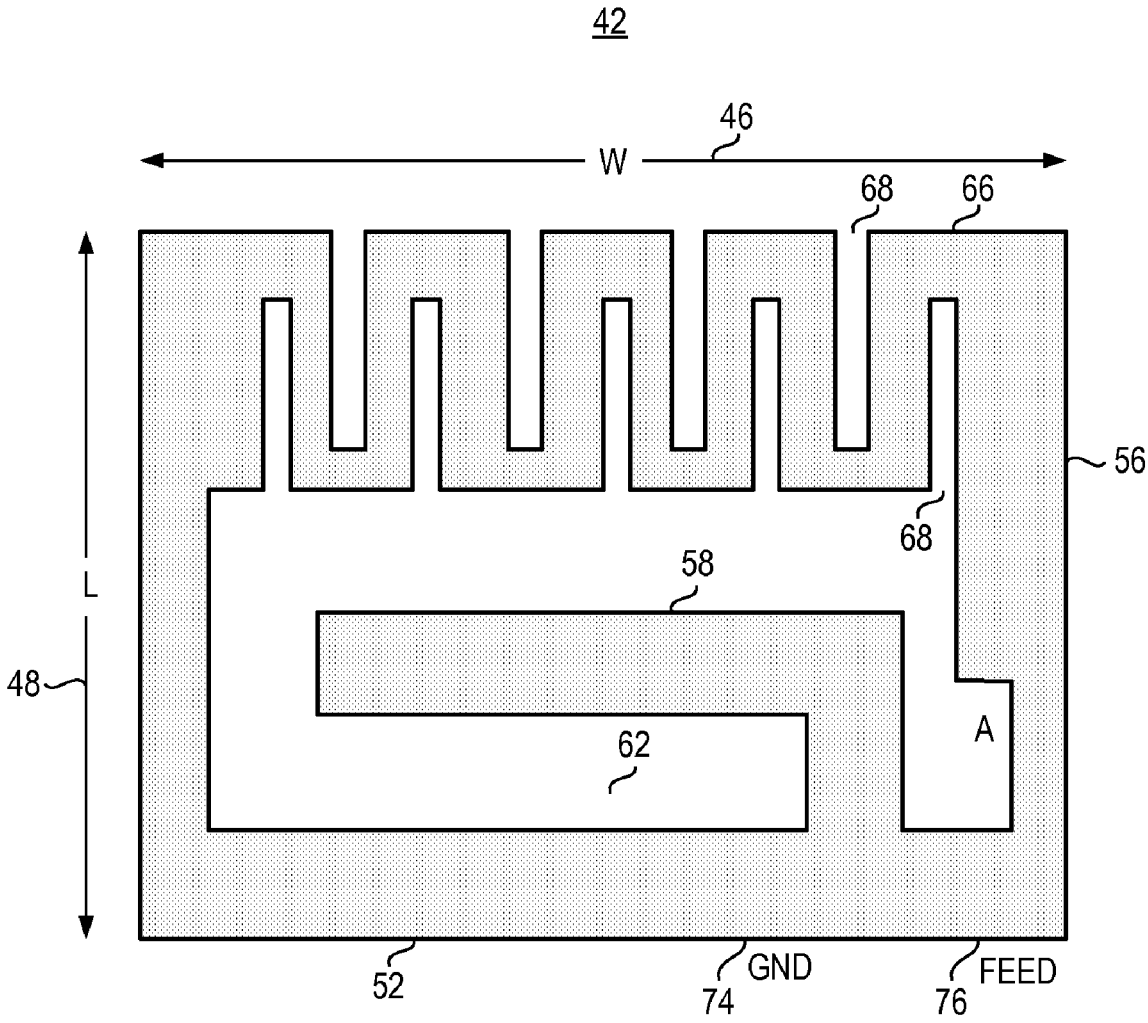
FIG. 2 illustrates a representation of the configuration of a hybrid strip antenna of an embodiment of the present invention.

FIG. 2 illustrates an exemplary implementation of the antenna of an embodiment of the present invention. The antenna is of widthwise dimensions 46 and lengthwise dimensions 48 permitting positioning of the antenna within the housing 44 (shown in FIG. 1). For example, the substrate is 35 mm×25 mm. The plan view of FIG. 2 illustrates the configuration of conductive traces formed upon a substrate 52. The substrate is formed of, or includes, a nonconductive plate or portion providing a surface permitting coating with a conductive material.

The antenna 42 forms a hybrid strip antenna having a set of radiation elements, a peripheral loop 56 and an L-shaped strip 58.

The peripheral loop extends about a periphery of the substrate and, in the exemplary implementation, extends to the peripheral edges of the substrate. The loop 56 forms an enclosed shape defining an interior area 62 at which the second resonant element, the L-shaped strip 58, is formed.

The peripheral loop 56 is here generally rectangular in configuration, formed of four side portions corresponding to the four sides of the substrate 52. The length of the peripheral loop is thereby defined by two widthwise-extending side portions and two lengthwise-extending side portions. The length of the peripheral loop is determinative of a first resonant frequency at which the antenna resonates. Through appropriate selection of the length of the peripheral loop, the first resonant frequency is thereby formed. Here, the first resonant frequency at which the peripheral loop is resonant at the lower frequency bands at which the mobile station is operable.

One of the side portions, here the top side portion (as shown) forms a meander line 66. The meander line 66 defines a meander-line length that is controlled by the number of, and dimensions of, non-conductive interdigitation fingers 68. Here, each of the interdigitation fingers 68 extend in generally parallel directions, of a number causing the meander line to be of a desired length. The meander line is also resonant at a resonant frequency, here at a frequency corresponding to a higher frequency band at which the mobile station is operable. In one implementation, the side portion at which the meander line is formed is first formed and then the interdigitation fingers etch away conductive material of the side portion. In another implementation, the meander line forms part of a pre-configured pattern defining where the coating of conductive material forming the antenna is applied upon the substrate 52. Tuning of the meander line, and of the peripheral loop, is made by altering the lengths of one or more of the fingers 68.

The L-shaped strip 58 is formed within the interior area defined by the peripheral loop 56. An end side of one of the legs of the L-shaped strip extends to, and is electrically coupled to, the peripheral loop. Here, the end of the shorter leg of the L-shaped strip extends to the outer peripheral loop 56, between the ground location 74 and the feed location 76. The ground and feed locations define contact links at which the hybrid strip antenna 42 is coupled to the transceiver circuitry 36 (shown in FIG. 1). The L-shaped strip 58 forms a resonant element that is resonant at a resonant frequency. The resonant frequency at which the strip 58 is resonant is determined by its length. Through appropriate selection of the length of the strip, the resonant frequency at which the element 58 is caused to be resonant corresponds to a frequency at which the mobile station is operable. In the exemplary implementation, the L-shaped strip is resonant at a frequency, similar to, i.e., close to, overlapping, or otherwise in the vicinity of the frequency at which the meander line 66 is resonant.

The antenna exhibits a stable radiation pattern and stable frequency band characteristics at all of the frequencies of its resonance, here the 800/900/1800/1900 MHz bands.

Figure 3:
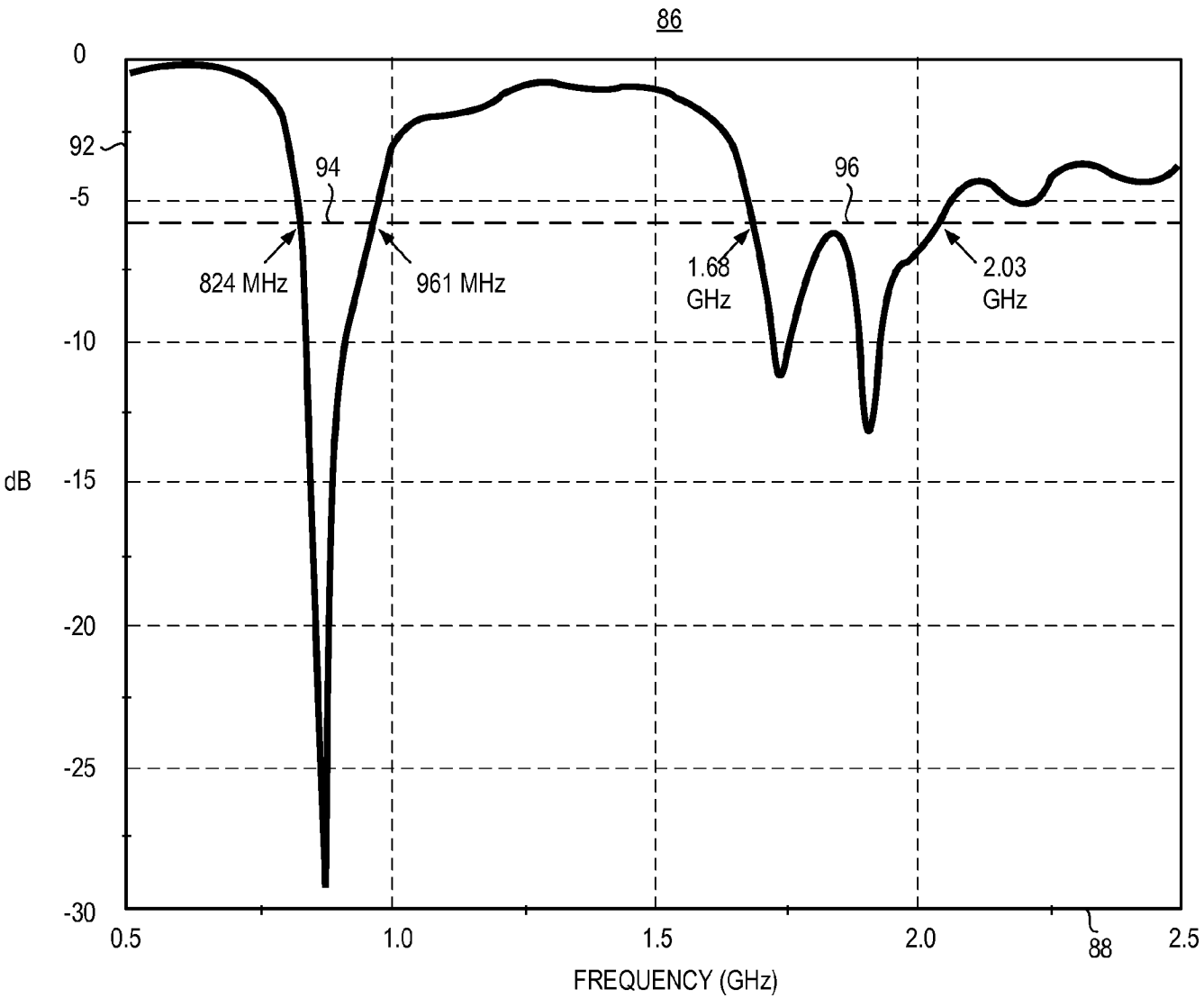
FIG. 3 illustrates a graphical representation of the antenna characteristics exhibited by the hybrid strip antenna shown in FIG. 2.

FIG. 3 illustrates a graphical representation 86 of the antenna characteristics of an exemplary antenna 42 of an embodiment of the present invention. In the representation, frequency is plotted along the abscissa axis 88 and the ordinate axis 92, scaled in terms of dB. A low-frequency pass band 94 extends between 824 MHz and 961.11519 MHz. And, a pass band 96 extends between 1682 MHz and 2038 MHz. The antenna transduces signal energy that is within the frequency bands 94 and 96. The frequencies defining the frequency bands 94 and 96 are altered by altering the lengths of the loop 56, meander line 66, and L-shaped strip 58. As the substrate 52 defines the dimensions of the hybrid strip antenna is of small dimensions, the hybrid strip antenna is positionable within the housing of a compact-size mobile station while also providing for operation at multiple frequency bands, such as the quad-bands of a quad-mode mobile station operable at the 800/900/1800/1900 MHz frequency bands.

Figure 4:
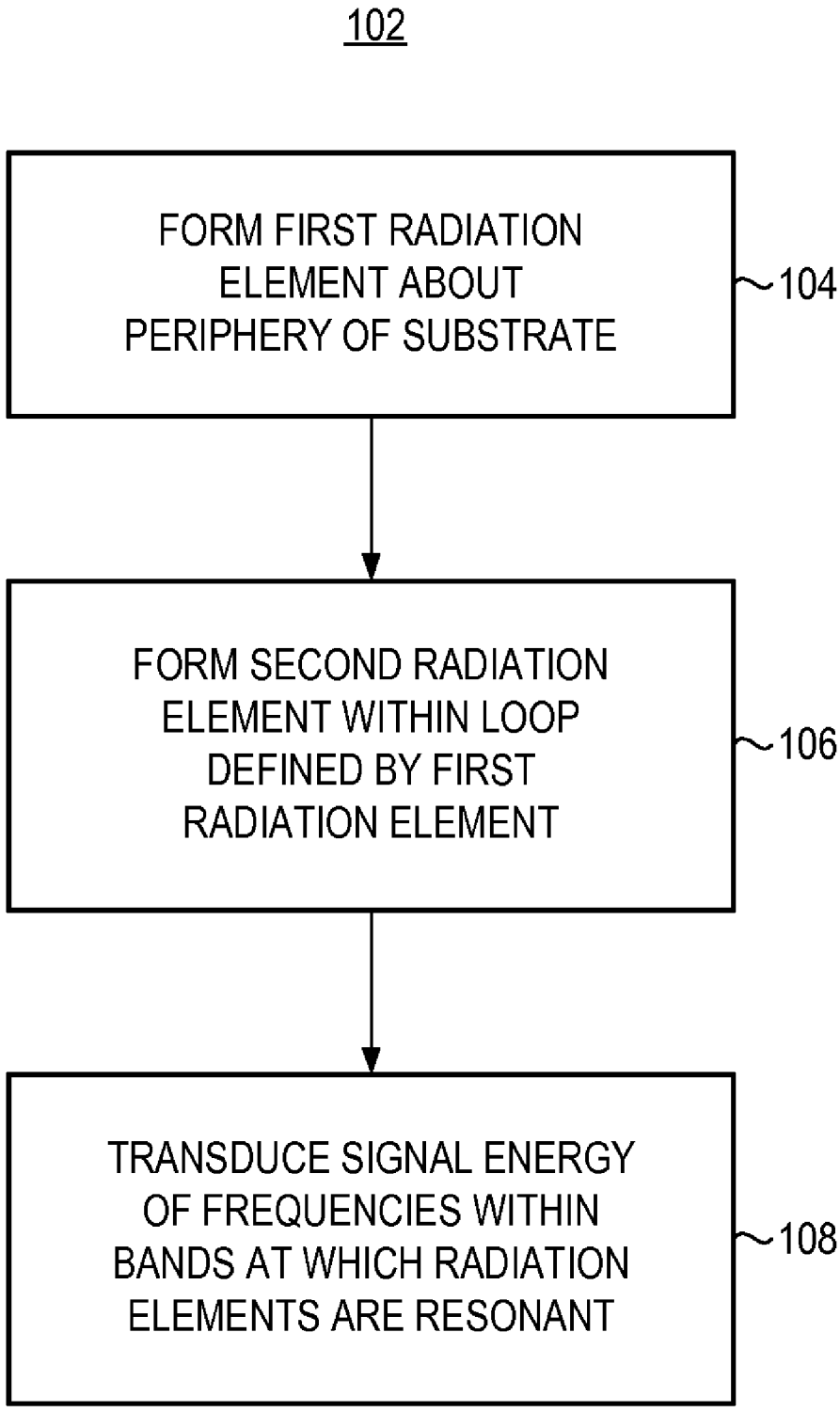
FIG. 4 illustrates a method flow diagram representative of the method of operation of an embodiment of the present invention.

FIG. 4 illustrates a method flow diagram, shown generally at 102, representative of the method of operation of an embodiment of the present invention. The method provides for the transducing of signal energy at a radio device.

First, and as indicated by the block 104, a first radiation element is formed about a periphery of the substrate. The first radiation element defines a loop configured to resonate within a first set of frequency bands. Then, and as indicated by the block 106, a second radiation element is formed upon an area of the substrate within the loop that extends about the periphery of the substrate. The second radiation element defines an L-shaped strip and is configured to resonate within a second set of frequencies.

And, as indicated by the block 108, signal energy is transduced within the first and second sets of frequency bands at which the first and second radiation elements are resonant.

A compact, hybrid strip antenna is provided that exhibits a stable radiation pattern and that exhibits stable frequency band characteristics. Because of the small dimensional requirements of the hybrid strip antenna, the hybrid strip antenna is amenable for positioning in a small-sized package, such as within the housing of a mobile station.

What is claimed is:

1. A hybrid strip antenna for a communication device operable at a first frequency band and at a second frequency band, said second frequency band being higher in frequency than said first frequency band, said hybrid strip antenna embodied upon a substrate, and said hybrid strip antenna comprising:

a first radiation element formed of a closed loop on the substrate and defining an interior area within the closed loop, the closed loop including a portion forming a meander line, the closed loop configured to be resonant within said first frequency band and the meander line electrical length being resonant at said second frequency band; and a second radiation element formed of a strip coupled to said first radiation element, and lying within the interior area defined by said closed loop forming said first radiation element, the strip forming the second radiation element and being configured to cause said second radiation element to be resonant within at least a portion of said second frequency band.

2. The hybrid strip antenna of claim 1 wherein the closed loop forming said first radiation element extends about a periphery of the substrate.

3. The hybrid strip antenna of claim 2 wherein the substrate comprises a first peripheral side, a second peripheral side, a third peripheral side, and a fourth peripheral side, and wherein the closed loop extends along the first, second, third, and fourth peripheral sides, respectively.

4. The hybrid strip antenna of claim 1 wherein the closed loop is of an electrical length, including said meander line electrical length, that is determinative of said first frequency band.

5. The hybrid strip antenna of claim 1 wherein the first frequency band includes 800 MHz.

6. The hybrid strip antenna of claim 1 wherein the second frequency band comprises 1800 MHz.

7. The hybrid strip antenna of claim 1 wherein the first frequency band includes 900 MHz.

8. The hybrid strip antenna of claim 1 wherein the second frequency band comprises 1900 MHz.

9. The hybrid strip antenna of claim 1 wherein the second frequency band includes 1800 MHz.

10. The hybrid strip antenna of claim 1 wherein the second frequency band includes 1900 MHz.

11. The hybrid strip antenna of claim 1 wherein said second radiation element further comprises an L-shaped conductor.

12. The hybrid strip antenna of claim 1 wherein the first radiation element closed loop further comprises first, second, third, and fourth loop sides, each respectively adjacent the next, and wherein said hybrid strip antenna further comprises an antenna feed point electrically connected to said first loop side and said third loop side further comprises said meander line.

13. A method for transceiving signal energy at a radio device operable at a first frequency band and at a second frequency band, said second frequency band being higher in frequency than said first frequency band, said method comprising the operations of:

forming a first radiation element about a periphery of a substrate, the first radiation element defining a closed loop that defines an interior area within the closed loop, the closed loop including a portion forming a meander line, the closed loop configured to resonate within said first frequency band and the meander line electrical length configured to resonate within said second frequency band;

forming a second radiation element upon an area of the substrate within the closed loop extending about the periphery of the substrate and coupling the second radiation element to the first radiation element at a feed point, the second radiating element defining a strip and being configured to resonate within said second frequency band; and transducing the signal energy within any of said first and second higher frequency bands at the first and second radiation elements.

14. The method of claim 13 further comprising the operation of connecting the first antenna element and the second antenna element to the radio device.

15. A hybrid strip antenna for a multi-band-capable mobile station, said hybrid strip antenna comprising:

a substrate positionable within the mobile station device;

a radiation loop disposed about a periphery of the substrate, said radiation loop being a closed loop, a portion of which includes a meander line along a portion thereof, said radiation loop resonant at a first frequency band, and the meander line thereof having an electrical length resonant at a second frequency band, said second frequency band being higher in frequency than said first frequency band; and a radiation L-shaped strip disposed on the substrate within an interior area defined by said radiation loop, said radiation L-shaped strip resonant within at least a portion of said second frequency band.

16. The hybrid strip antenna of claim 15 wherein the first radiation closed loop further comprises first, second, third, and fourth loop sides, each respectively adjacent the next, and wherein said hybrid strip antenna further comprises an antenna feed point electrically connected to said first loop side and said third loop side further comprises said meander line.

17. The hybrid strip antenna of claim 15 wherein the closed loop is of an electrical length, including said meander line electrical length, that is determinative of said first frequency band.

* * * * *